United States Patent [19]

Summerlin et al.

[11] Patent Number: 4,815,310

[45] Date of Patent: Mar. 28, 1989

[54] FASTENER INSTALLATION APPARATUS

[75] Inventors: Frederick A. Summerlin, St. Albans; William H. Frearson, Letchworth; James C. Hendry, Great Barford, all of England

[73] Assignee: Avdel Limited, A British Company, Welwyn Garden City, England

[21] Appl. No.: 177,364

[22] Filed: Apr. 4, 1988

[30] Foreign Application Priority Data

Apr. 9, 1987 [GB] United Kingdom ..... 8708459

[51] Int. Cl.[4] ..... B21J 15/34

[52] U.S. Cl. ..... 72/391; 72/453.17; 72/440

[58] Field of Search ..... 72/391, 440, 453.17; 29/243.53

[56] References Cited

U.S. PATENT DOCUMENTS

| | | | |
|---|---|---|---|
| 1,337,379 | 4/1920 | Zawada | 72/440 |
| 2,737,066 | 3/1956 | Riemenschneider | 72/440 |
| 3,047,182 | 7/1962 | Batten | 72/391 |
| 3,374,656 | 3/1968 | Di Maio | 72/391 |
| 3,657,915 | 4/1972 | Lee | 72/391 |
| 3,981,177 | 9/1976 | Di Maio et al. | 72/391 |
| 4,088,004 | 5/1978 | Di Maio et al. | 72/391 |

*Primary Examiner*—David Jones

*Attorney, Agent, or Firm*—Oblon, Fisher, Spivak, McClelland & Maier

[57] ABSTRACT

A hand-held pneumatically-powered breakstem rivet placing tool comprises a pulling head (12) driven by a pneumatic piston and cylinder device (13). The drive is transmitted by way of a chain (15), one end (45) of which is secured to the body (11) of the tool and the other end (49) of which is secured to the piston rod (35) of the pneumatic device. Between its two ends the chain forms a loop which passes over a roller (52) which is connected to the pulling head (12) by way of a link mechanism (54, 58). When the pneumatic device (13) is actuated, the movable end (49) of the chain is pulled down, thus pulling the roller (52) and driving the head (12) to place a rivet. The roller (52) is carried on the top of a plunger (56) which is continuously urged upwards by air pressure in the cylinder (63) in which it slides, thereby to return the mechanism to its original position after a rivet has been placed.

7 Claims, 7 Drawing Sheets

FASTENER INSTALLATION APPARATUS

The invention relates to fastener installation apparatus, for example of the type intended to install blind breakstem rivets. Such fastener installation apparatus essentially comprises a fastener installation head (for acting on the fastener), driving means for drivingly operating the fastener installation head, and transmission means for transmitting the drive from the driving means to the head. Such apparatus is commonly arranged to be hand-held but to include power-operated driving means. In one very common form of apparatus the driving means is operated by pneumatic power, using air under pressure supplied by an air line.

The force available from a pneumatic piston is limited by the air pressure available, which in turn is limited by safety considerations. For a given air pressure the force is proportional to the area of the piston, but this latter is limited in practice by the size of apparatus which can be held and manipulated by hand. It is therefore necessary to arrange that the transmission means increases the force applied to the installation head, to provide sufficient force to install a fastener, for example in the case of a blind breakstem rivet by deforming the shell of the rivet and then fracturing the stem under tension. Nearly all such apparatus uses a hydraulic intensifier as the transmission means to increase the force between the pneumatic piston and the fastener installation head. However a hydraulic intensifier brings practical problems associated with leakage of hydraulic fluid and the need to re-prime the hydraulic system, which may not be easy to do properly and correctly under the workshop conditions under which such apparatus is commonly used. Various forms of mechanical transmission means have been proposed, but these also have presented problems.

The present invention is intended to provide fastener installation apparatus which is simple in construction, reliable n operation, and needs little maintenance in use.

Accordingly, the present invention provides fastener installation apparatus comprising:

a fastener installation head;

driving means for drivingly operating the fastener installation head;

and mechanical transmission for transmitting a mechanical drive from the driving means to the head;

which transmission means comprises an elongated tension-supporting flexible member for transmitting the drive by means of tension through the elongated flexible member.

Further features of the invention will become apparent from the following description, and from the appended claims.

A specific embodiment of the invention, and a modification thereof will now be described by way of example and with reference to the accompanying drawings, in which.

Figure 1:
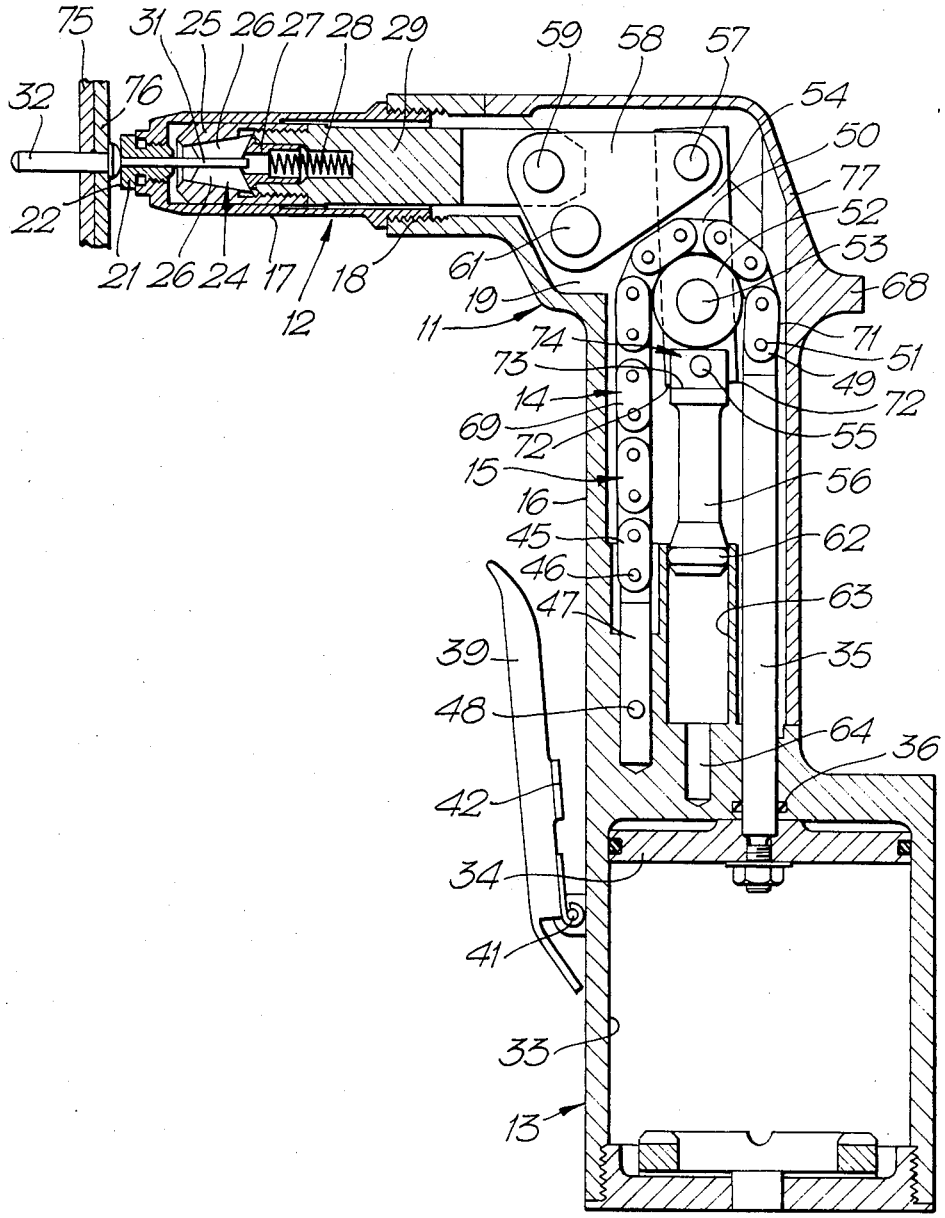
FIGS. 1, 2 and 3 are axial sections on the line 1—1 of FIG. 4 illustrating successive stages of the operation of a hand-held pneumatic powered installation tool in installing a blind breakstem rivet.

The blind rivet installation tool of this example comprises a rigid metal body casting 11, which carries its upper end a rivet installation head 12 and at its lower end a pneumatic piston and cylinder device 13 for driving the installation head. The mechanical transmission drive 14 from the pneumatic device to the installation head comprises an elongated tension-supporting flexible member in the form of a chain 15, through which the mechanical drive is transmitted by tension. The chain is accomodated within the part 16 of the body 11 between the head 12 and pneumatic device 13, which part provides a hand grip for the tool.

The rivet installation head 12 comprises a tubular barrel 17 which is threaded at 18 at its rear end and thereby screwed into an enlarged mechanism chamber 19 formed as an integral part of the body 11 at the top of the handgrip 16. The front end of the barrel carries a nosepiece 21 having an annular anvil front face 22 surrounding an aperture 23. Slidable inside the barrel is rivet gripping and pulling means 24 comprising a collet 25 containing jaws 26 which are urged closed by a jaw-follower 27 and spring 28. The rear of the collet is secured to a drawbar 29 which can be retracted with some force by the pneumatic device 13 acting through the transmission drive 14. When the stem 31 of a rivet 32 is inserted through the aperture 23 and gripped by the jaws, whilst the shell 32 of the rivet contacts the anvil 22, and the pneumatic means is actuated, the rivet stem is pulled with respect to its shell, so that the rivet shell deforms (FIGS. 2 and 3) and the rivet stem then breaks, thus installing the rivet.

The pneumatic device 13 comprises a cylinder 33 formed integrally in the body casting at the lower end thereof. In the cylinder slides a piston 34, to which is connected a piston rod 35 which projects through a seal 36 and up inside the hand grip portion 16 of the body. An air line (not shown) is connected via a coupling 37 (FIGS. 5, 6 and 7) to a manually operated valve 38 on top of the cylinder 33. A trigger 39 is pivoted at 41 at its lower end in front of the cylinder 33 and extends in front of the hand grip 16. An extension 42 sideways on the trigger lies in front of the front end of the push rod 43 of the valve. When the trigger 39 is squeezed towards the hand grip 16, the valve 38 is operated, to admit air under pressure via a bore 44 (FIG. 5) to the space in the cylinder 33 above the piston 34, thus driving the piston 34 and piston rod 35 downwards. This applies force (in a manner to be described below) to the drawbar 29, so as to instal or place a rivet.

The construction and operation of the rivet installation head 12, and the pneumatic driving means 13, are conventional in the art, except that when a hydraulic intensifier is used to transmit force to the installation head it is usual to drive the piston rod upwards to place a rivet, rather than downwards.

The mechanical transmission means, which is provided by the present invention, will now be described.

As previously mentioned, the transmission device 14 comprises a chain 15, which has parallel pairs of links spaced apart by, and connected to adjacent pairs of links, by cross pins. One end 45 of the chain is secured to the rigid body casting 11, by means of the end cross pin 46 of the chain passing through a lug 47 which is secured into the body 11 by means of a pin 48. The other end 49 of the chain is secured to the upper end of the pneumatic piston rod 35, through which the end cross pin 51 passes.

At a position 50 between its fixed end 45 and its movable end 49, the chain passes around a roller 52 through which the chain transmits force to the installation head 12. The chain 15 turns through 180 degrees as it goes around the roller. The roller is carried on a shaft 53 which is carried between a pair of parallel links 54. The bottom ends of the links 54 are carried for limited pivoting movement on a pin 55, which extends transversely through the reduced thickness upper end 74 of a return plunger 56. Pivoting of the links 54 on the pin 55 is limited by contact of the bottom corners 72 of links 54 on shoulders 73 on each side of the portion 74, so that there is always a clearance between the roller 52 and the top of the plunger 56. The upper ends of the two links 54 are carried on a pin 57 which projects transversely through the rear end of a bell crank plate 58. The front of the bell crank 58 carries a tranverse front crank pin 59 which also passes through the rear end of the drawbar 29. The bottom of the bell crank plate 58 is pivoted on a pivot pin 61 carried between the side walls of the mechanism chamber 19, which houses the bell crank mechanism.

The return plunger 56 has at its lower end a seal 62, which seals against a return cylinder 63 in which the plunger slides. The plunger 56 touches its cylinder 63 only around its annular seal 62, and so can rock slightly backwards and forwards about the seal position. The return cylinder 63 is connected by means of intersecting bores 64, 65 and 66 (FIGS. 1 and 6) to the compressed air inlet side of the valve 38 (FIG. 6), so that compressed air is always supplied to the return cylinder 63, regardless of the condition of the valve 38.

It will be apparent from the foregoing description and the accompanying drawings that the part 69 of the chain 15 between its fixed end 45 and the roller 52 lies substantially parallel to the part 71 of the chain between the roller 52 and the movable end 49 of the chain, with the return plunger 56 lying between them and also parallel to them. Both parts 69, 71 of the chain, and the return plunger 56, are accomadated within the hand grip portion 16 of the tool.

Since when the tension is applied to the chain 15, the chain transmits force to the roller 52 only in a direction radial to the roller, and not rotationally of the roller (although in use the roller will be rotated by the chain due to frictional contact), the roller is smooth (i.e. does not have teeth, like a sprocket).

Figure 5:
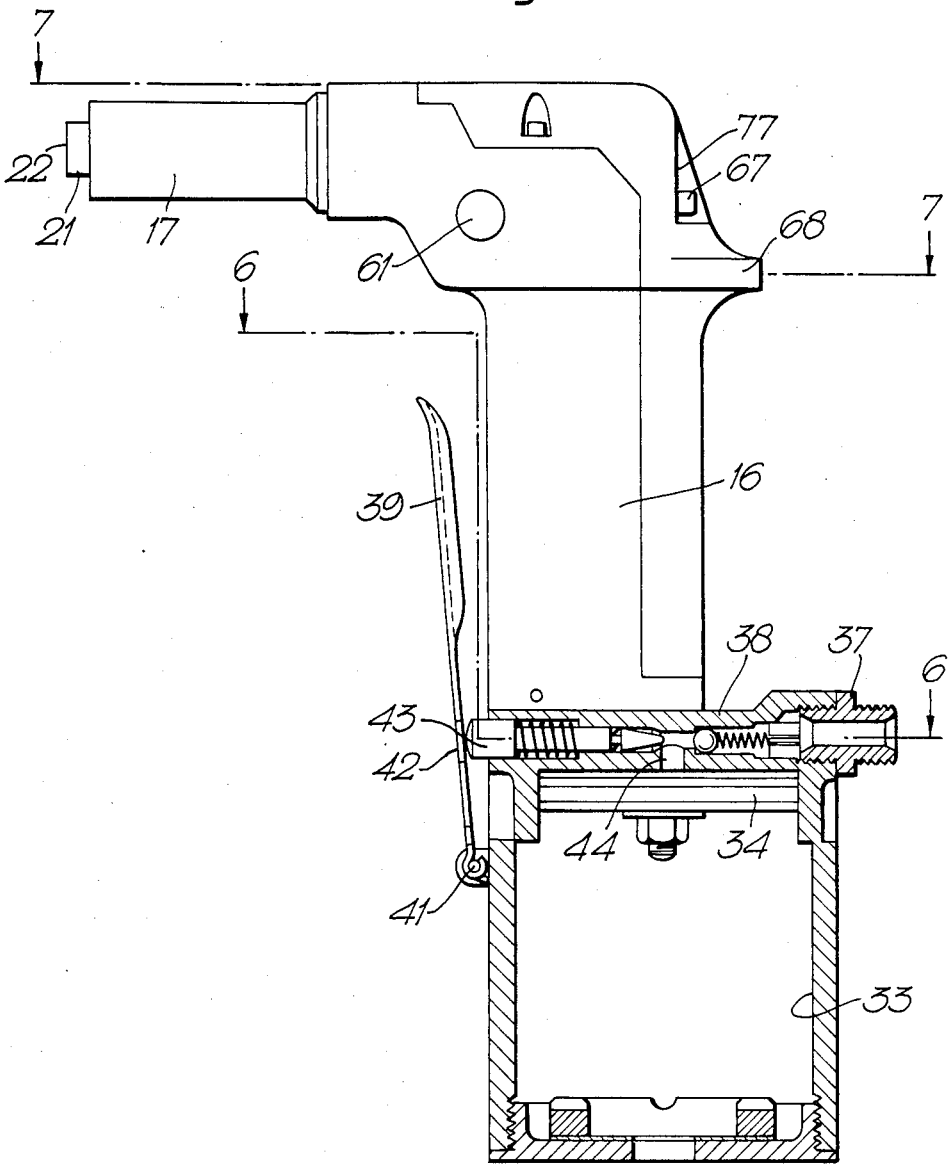
FIG. 5 is a section on the cranked line 5—5 of FIG. 1.
Figure 6:
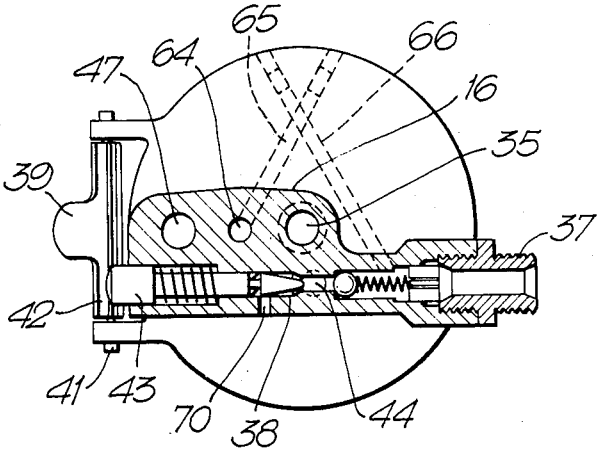
FIG. 6 is a section on the cranked line 6—6 of FIG. 5.
Figure 7:
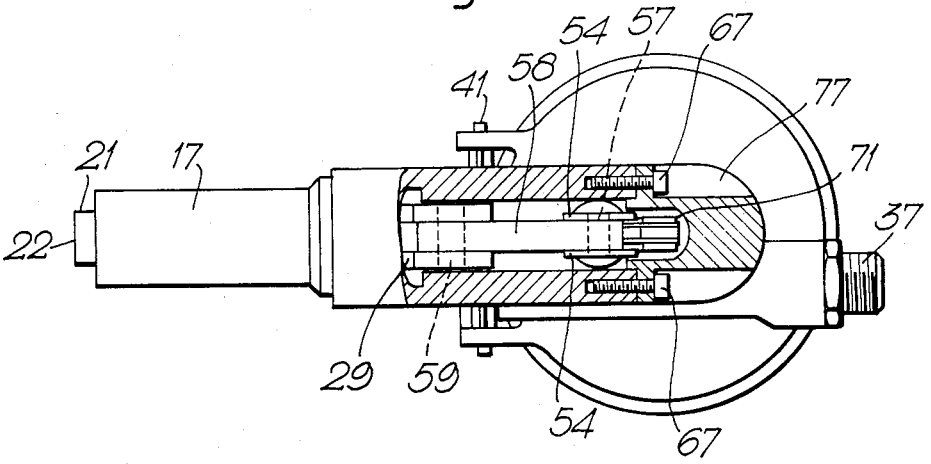
FIG. 7 is a section on the cranked line 7—7 of FIG. 5.

Construction of the tool, and access to the transmission mechanism if required, is facilitated by the design feature that the back of the hand grip portion 16, and the back top of the mechanism chamber 19, are provided by a cover 77 which is separate from the body casting 11. Advantageously the cover may be made of moulded plastics material, and it is secured to the body casting by two screws 67 (FIGS. 5 and 7). It incorporates a rearwardly projecting ledge or lug 68 which facilitates holding of the tool by the operator.

The operation of the tool, and in particular its chain transmission system, will be described.

The normal or un-actuated state of the tool is as shown in FIGS. 1 and 5. The valve 38 is not actuated, so that pressure air is not applied to above the piston 34, but pressure air is continuously applied via bores 64, 65 and 66 to below the return plunger 56. The resulting force is sufficient to keep the plunger 56 in its uppermost position, in which the force which the roller 52 exerts on the loop of chain 15 passing over it keeps the piston 34 at the top of the cylinder 33, and the links 54 are raised and keep the rear end of the bell crank plate 58 raised and the drawbar 29 and the rivet gripping and pulling means 24 pushed forwards.

These positions are illustrated in FIG. 1. It will be seen that the axis of forward crank pin 59 is slightly below the centre line of the barrel 17, so that the drawbar is thus tilted slightly downwards at the rear with respect to the barrel 17. The axis of the rear crank pin 57 is slightly in front of the axis of the return cylinder 63. The plunger 56 may also be tilted slightly forwards about the position of its seal 62 at its lower end.

A breakstem rivet is then inserted in the tool by inserting the stem 31 into the anvil aperture 23 and between the jaws 26 which move backwards and apart to accept it, until the head of the shell 32 abuts the anvil 22. The shell of the rivet is then inserted through appropriately sized aligned holes in a workpiece, which in this example comprises two sheets 75, 76 to be riveted together, until the underside of the shell head abuts the nearer sheet. This is the position illustrated in FIG. 1.

The tool is now actuated by the operator pressing the trigger 39. This opens the valve 38, admitting pressure air to the cylinder 33 above the piston 34. Since the cross-sectional area of the piston 34 is many times greater than the cross-sectional area of the return plunger at its seal 62, the force generated by the pressure air on the piston 34 is many times that generated on the plunger. This applies tension to the chain 15. In addition, the geometrical arrangement of the chain 15 is such that the downwards force applied by the chain to the roller 52 is twice the downwards force exerted on the movable end 49 of the chain by the piston 34. Thus there is a substantial downwards resultant force on the roller 52.

Figure 2:
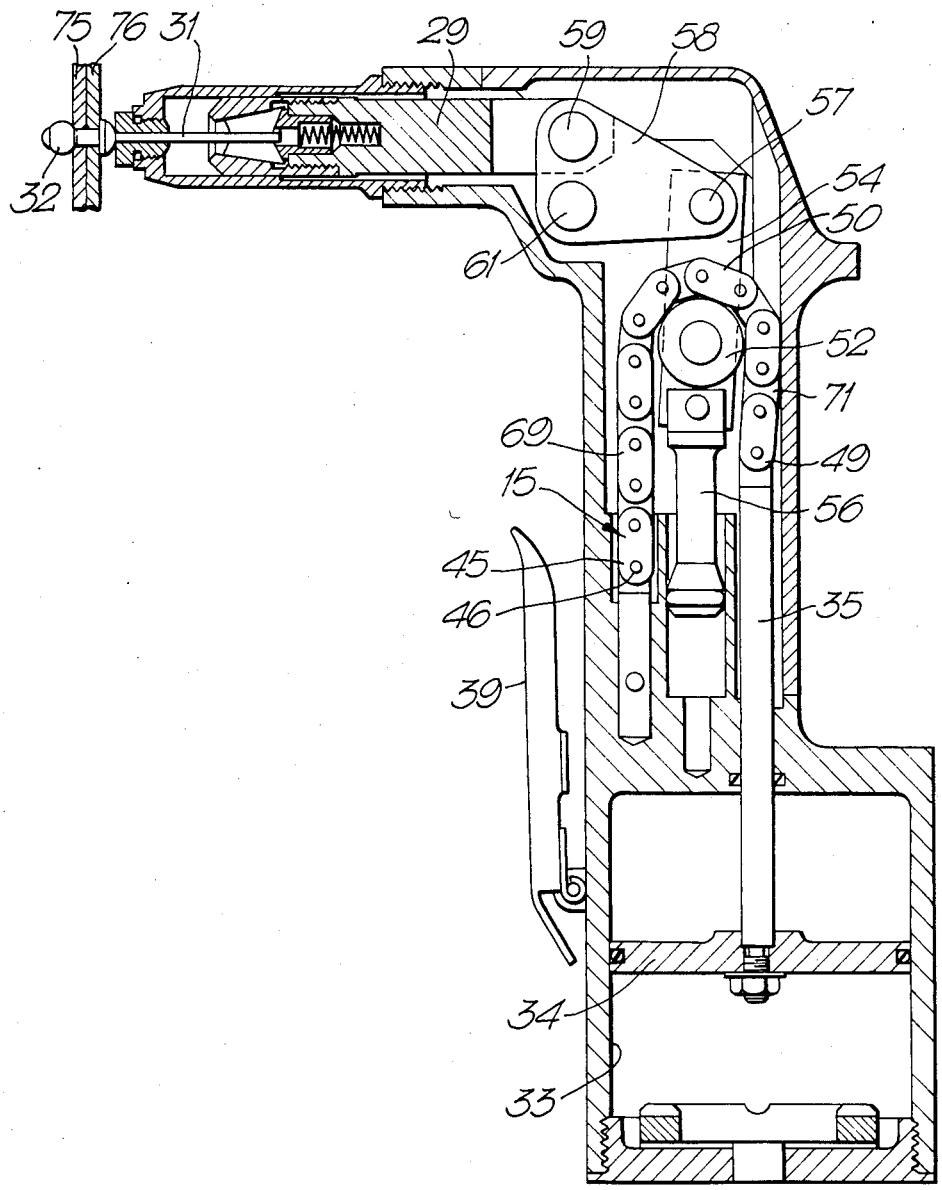
Figure 3:
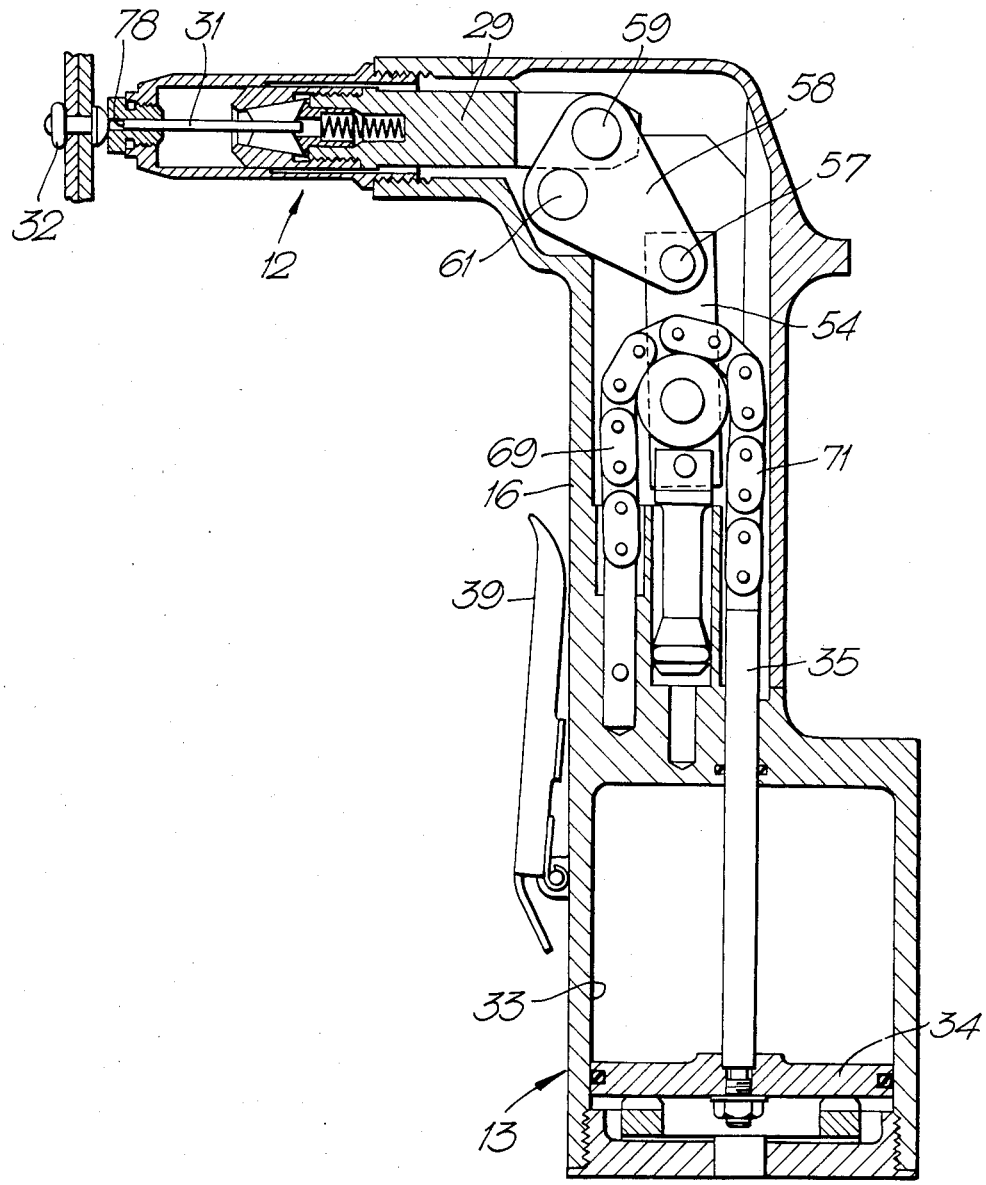
Figure 4:
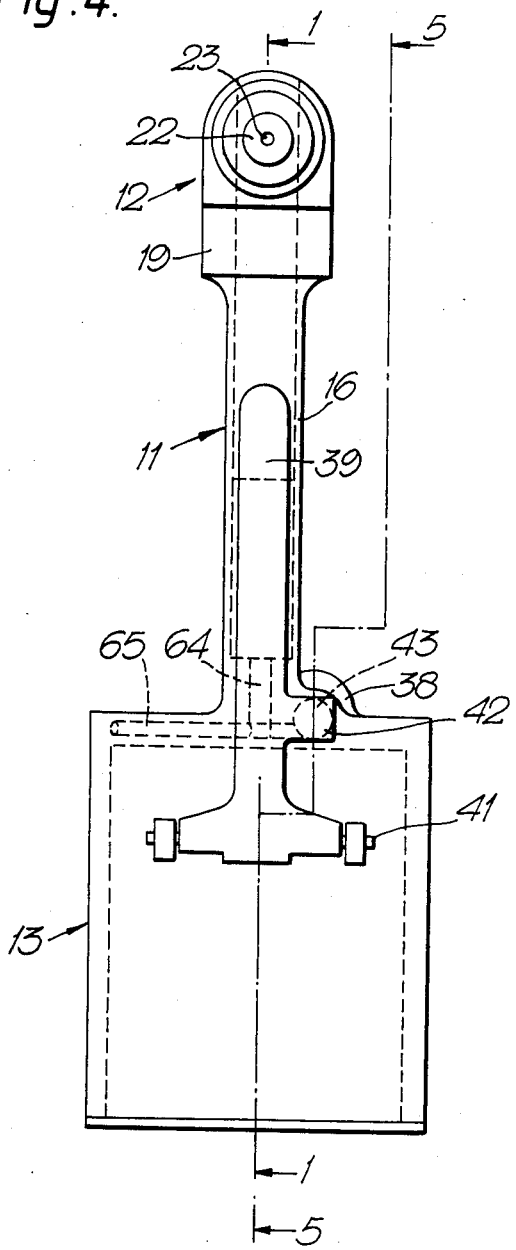
FIG. 4 is a front elevation of the tool.

The drawbar 29 starts to retract, and the jaws 24, 26 grip the rivet stem 31 and apply an increasing tension to it. This causes the shell 32 of the rivet, behind the sheet 75, to deform. FIG. 2 shows the rivet shell partially deformed, and the drawbar 29 partly retracted. It will be seen from FIG. 2 that due to the rotation of the crank 58 about its pivot 61, the axis of front crank pin 59 has risen above the axis of the barrel 17, so that the rear end of the drawbar 29 is tilted upwards with respect to the barrel 17. The rear crank pin 57 has moved backwards, due to the rotation of the crank, so that it is now slightly behind the axis of the return cylinder 63. The plunger 56 may also tilt backwards slightly about its seal 62. The roller 52 and plunger 56 have moved downwards by half of the distance through which the piston 34 has moved downwards. Under the force applied to the stem 31 of the rivet, the shell continues to deform further to form a blind head on the rivet, as illustrated in FIG. 3. The resistance to further deformation of the shell increases steeply, and the stem of the rivet then breaks (at 78, FIG. 3) under the tension applied to it. The drawbar 29, piston 34, and the associated mechanism linking them are then free to move to the limit of their travel, as illustrated in FIG. 3. Due to the continued rotation of the crank plate 58 about its pivot 61, the drawbar 29 is now again tilted downwardly, and the links 54 are again inclined forwardly.

The tool can now be removed from the installed rivet, and the operator releases the trigger 39. The valve 38 closes under the action of its internal spring, shutting off the air pressure to above the piston 34. The pressure air below the return plunger 56 causes the plunger to rise, returning the chain 15, piston 34 and drawbar 29 to their original positions, shown in FIG. 1.

Air from above the piston 34 exhausts through a bore 70 from valve 38 to outside air.

Figure 8:
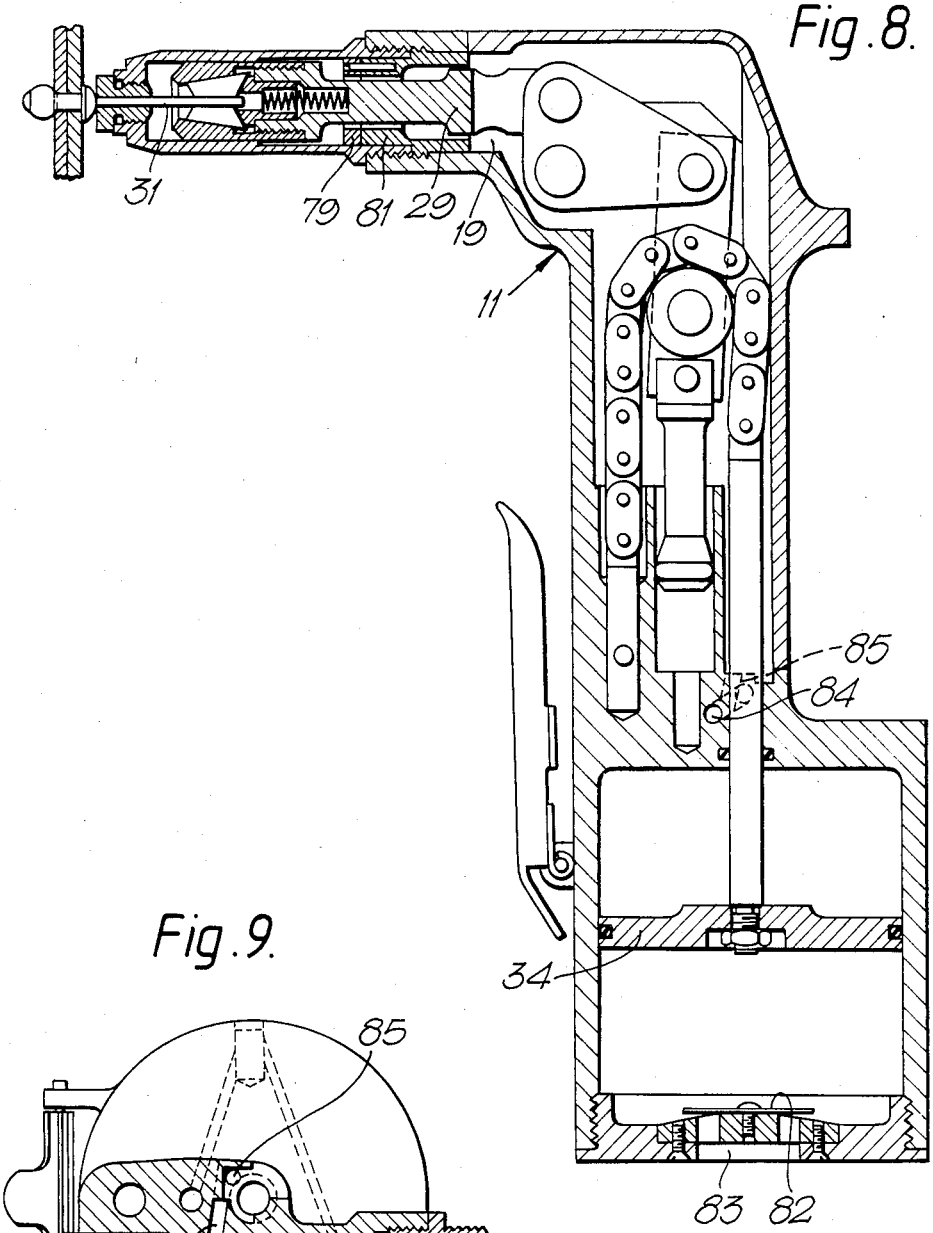
FIGS. 8 and 9 are similar to FIGS. 2 and 6 respectively but show a slightly modified tool.
Figure 9:
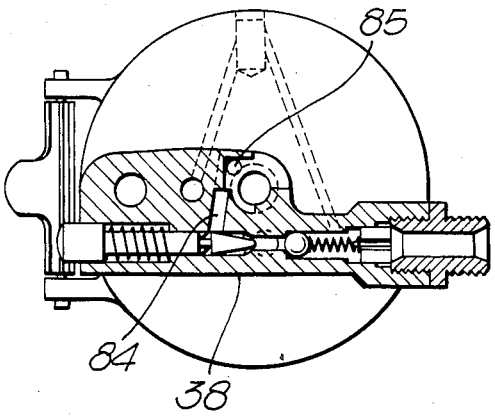

FIGS. 8 and 9 illustrate a slightly modified version of the tool described above.

Referring to FIG. 8, a buffer, comprising a nylon ring 79 supported by a steel yoke 81, is provided within the front part of the mechanism chamber, to absorb the impact of the drawbar 29 when the rivet stem 31 breaks. An air damping valve 82 is provided in the base of the cylinder 33 to restrict exhaust airflow, through vent 83 from under the piston 34, when the piston 34 descends.

This decellerates the piston 34 and helps to reduce shock and noise when the rivet stem breaks. Referring to FIGS. 8 and 9, the air from above piston 34 exhausts via intersecting bores 84 and 85 into the inside of the body casting 11, when the piston 34 rises. This diverts the exhaust air away from the operator's hand, and reduces noise.

The tool described in the foregoing examples is advantageous in practice, in that the chain transmission is simple in construction and operation, robust, and requires little service and maintenance. The arrangement of the chain gives a mechanical advantage of 2:1, i.e. the force exerted by the chain on the transmission roller 52 is twice the force exerted by the piston 34. At the same time the two straight parts 69, 71 of the chain 15, passing around the roller 52, with the return plunger 56 between them, are all accomodated within the handgrip portion 16 of the tool. The chain transmission is also low in weight and mass.

The return plunger 56 is continuously supplied with pressure air, so that no valve is needed to shut this supply off intermitently, which also simplifies construction of the tool and reduces maintenance. The continuous thrust also keeps the roller 52 in contact with the chain 15 whilst the tool is operating, thus reducing noise and vibration.

The invention is not restricted to the details of the foregoing example. For instance, the configuration of the chain 15 may take any convenient arrangement. The elongated flexible member need not be a chain, but could be, for example, one or more straps or flexible wires or cables of adequate strength.

We claim:

1. Fastener installation apparatus comprising:

a fastener installation head;

driving means for drivingly operating the fastener installation head;

and mechanical transmission means for transmitting a mechanical drive from the driving means to the head;

which transmission means comprises an elongated tension-supporting flexible member for transmitting the drive by means of tension through the elongated member;

which apparatus also includes a rigid framework: in which apparatus:

the elongated flexible member is secured at a first position along its length with respect to the rigid framework, and at a second position along its length to the driving means;

the elongated flexible member, at a third position along its length intermediate the first and second positions, passing around and being in driving contact with a roller or other load-bearing member from which force is transmitted to the installation head;

such that when the driving means applies to the elongate flexible member at its second position a given force, a greater force is applied by the elongate flexible member to the load-bearing member.

2. Fastener installation apparatus as claimed in claim 1, in which the part of the elongated flexible member between its first position and its third position is substantially parallel to the part of the elongated flexible member between its third position and its second position.

3. Fastener installation apparatus as claimed in claim 1, including return means for applying a return force to the load-bearing member, in the opposite direction to the force applied to it by the elongated flexible member.

4. Fastener installation apparatus as claimed in claim 2, in which including return means for applying a return force to the load-bearing member, in the opposite direction to the force applied to it by the flexible member which return means is positioned between the two substantially parallel parts of the elongated flexible member.

5. Fastener installation apparatus as claimed in any of the preceding claims, which is intended to be hand held and includes a hand grip portion, in which the elongate flexible member is accomodated substantially within the hand grip portion.

6. Fastener installation apparatus as claimed in claim 5, in which the installation head and the driving means are at opposite ends of the hand grip portion.

7. Fastener installation apparatus as claimed in claim 3, in which the driving means is pneumatically powered and which includes valve means to actuate the driving means to drive the installation head to install a fastener;

and in which the return means is continuously pneumatically powered to apply continuously to the load-bearing member a return force which is substantially less than the driving force applied to it by the elongated flexible member when the valve means actuates the driving means.

* * * * *